US005537195A

United States Patent [19]

Sagara et al.

[11] Patent Number: 5,537,195

[45] Date of Patent: Jul. 16, 1996

[54] SHEET-ACCOMMODATING CASSETTE WITH MAIN CONTAINER AND SUB CONTAINER

[75] Inventors: Seiji Sagara, Kawasaki; Kiyoshi Amano; Ken Murooka, both of Tokyo, all of Japan

[73] Assignee: Canon Kabushiki Kaisha, Tokyo, Japan

[21] Appl. No.: 62,338

[22] Filed: May 17, 1993

[30] Foreign Application Priority Data

Jun. 2, 1992 [JP] Japan ..... 4-141559
Mar. 9, 1993 [JP] Japan ..... 5-048071

[51] Int. Cl.[6] ..... G03G 21/00

[52] U.S. Cl. ..... 355/311; 271/164; 271/171; 271/223; 355/309

[58] Field of Search ..... 355/308, 309, 355/311, 72, 75; 271/144, 164, 171, 223, 213

[56] References Cited

U.S. PATENT DOCUMENTS

| | | | |
|---|---|---|---|
| 4,780,740 | 10/1988 | Fukae | 271/171 X |
| 5,002,266 | 3/1991 | Kikuchi et al. | 271/3 |
| 5,085,422 | 2/1992 | Sagara | 271/162 |
| 5,188,351 | 2/1993 | Gysling | 271/171 |
| 5,313,257 | 5/1994 | Kashima et al. | 355/311 X |

FOREIGN PATENT DOCUMENTS

| | | | |
|---|---|---|---|
| 56-165639 | 12/1981 | Japan | 271/164 |
| 58-139961 | 8/1983 | Japan | 271/223 |
| 59-203025 | 11/1984 | Japan | 271/171 |
| 61-203047 | 9/1986 | Japan | 271/223 |
| 61-217465 | 9/1986 | Japan | 271/223 |
| 61-238655 | 10/1986 | Japan | 271/223 |
| 62-79129 | 4/1987 | Japan | 271/171 |
| 2-127324 | 5/1990 | Japan | 271/171 |
| 4-140228 | 5/1992 | Japan | 271/171 |

*Primary Examiner*—Arthur T. Grimley
*Assistant Examiner*—Shuk Y. Lee
*Attorney, Agent, or Firm*—Fitzpatrick, Cella, Harper & Scinto

[57] ABSTRACT

A sheet-accommodating cassette includes a cassette body for accommodating sheets. The cassette body is made up of a main container and a sub container. Both the main container and the sub container have a plurality of engagement portions which enable them to be coupled to each other at one of a plurality of positions selected according to the size of the sheets to be accommodated. A sheet-accommodating cassette, which is formed by coupling the main container to the sub container in such a manner that the cassette can accommodate sheets of a large size, is housed in an image-forming apparatus body with part of the cassette protruding from the image-forming apparatus body.

18 Claims, 12 Drawing Sheets

SHEET-ACCOMMODATING CASSETTE WITH MAIN CONTAINER AND SUB CONTAINER

BACKGROUND OF THE INVENTION

1. Field of the Invention

The present invention relates to a sheet-accommodating cassette used in an image forming apparatus, such as a copying machine or a printer, for accommodating sheets supplied to the image-forming apparatus.

2. Description of the Related Art

In recent years, the number of different sizes of sheets used in copying machines or printers has increased, enabling the user to use a variety of sheet sizes. Consequently, there has been an increasing demand for a sheet-accommodating cassette corresponding to sheets of various different sizes.

To satisfy this, there are sheet-accommodating cassettes corresponding to individual sheet sizes which the user can selectively purchase. However, this requires the manufacturer to manufacture and handle a variety of sheet-accommodating cassettes, decreasing its efficiency and increasing its production cost.

The user must selectively purchase various types of sheet-accommodating cassettes, which are costly and require a large space for storage. Therefore, this way of manufacturing and preparing sheet-accommodating cassettes corresponding to individual sheet sizes is not satisfactory for either the manufacturer or the user.

Hence, a universal cassette capable of accommodating sheets having various different sizes has been proposed. In a conventional universal cassette, a sheet end portion-restricting member (including a side-restricting member for restricting the side portion of a sheet and a rear end-restricting member for restricting the rear end of a sheet) is provided so as to be movable in the sheet-accommodating cassette. Each of the end portion-restricting members moves according to the size of the sheet used.

However, the above-described conventional universal cassette has the following problems.

In a conventional universal cassette, a sheet-accommodating cassette body (container) is designed to accommodate maximum sized sheets, and the movement of the end portion-restricting member provided in the cassette body enables the cassette body to accommodate sheets having smaller sizes. Thus, even when the maximum-sized sheets are not used, the large size sheet-accommodating cassette must be used. Such a cassette is not easy to handle in terms of its weight and size.

The large universal cassette is disadvantageous to both the manufacturer and the seller, due to increases in manufacturing and transportation costs.

Furthermore, there is a trend towards reduction in the size of the image-forming apparatus, such as a copying machine or a printer, and the size of sheets mainly used in image-forming apparatuses is thus A4 or letter size. Under such circumstances, the use of a large universal cassette designed for sheets of legal size, which is the maximum size, increases the effective area of the image-forming apparatus body required to install the apparatus body, impeding the reduction of the size of the apparatus and adversely affecting its design. Particularly, in a small desktop personal printer, the use of such a large sheet-accommodating cassette cannot satisfy the user's desire for reducing the size of the apparatus.

SUMMARY OF THE INVENTION

In view of the aforementioned problems of the prior art, an object of the present invention is to provide a universal cassette which can satisfy the user's demand for ease of handling the universal cassette and for reduced production cost, and which does not limit reducing the size of the image-forming apparatus.

To achieve the above-described object, the present invention provides a sheet-accommodating cassette which comprises a cassette body for accommodating sheets. The cassette body is made up of a main container and a sub container. Both the main container and the sub container have a plurality of engaging portions which enable the main container to be coupled to the sub container at one of a plurality of positions selected according to the size of the accommodated sheet. The main container and the sub container may be slidably coupled to each other.

Both the main container and the sub container have a box-like form which is open at one side surface thereof, and may be coupled to each other with the open side surfaces facing each other. The main container and the sub container may be coupled to each other through the engagement portions provided on three surfaces of the containers consisting of the two side surfaces and the bottom surface.

A sheet-accommodating cassette, which is formed by coupling the main container to the sub container in such a manner that the cassette can accommodate a large size sheet, is housed in an image-forming apparatus body with part of the cassette protruding therefrom.

In this way, a sheet-accommodating cassette having an optimum size corresponding to the desired size of the sheets can be provided by coupling the main container to the sub container according to the size of the sheets to be accommodated in the cassette.

Since the main container and the sub container are coupled to each other through engaging portions provided on three surfaces consisting of the side surfaces and the bottom surface, sufficient coupling strength can be obtained.

In the present invention, a sheet-accommodating cassette accommodating a desired size sheet can be provided by coupling the two containers according to the sheets used. It is therefore possible to provide a sheet-accommodating cassette which is easy to handle.

A further object of the present invention is to provide an image-forming apparatus which forms an image on a sheet sent from a sheet-accommodating cassette as described herein.

Furthermore, an image-forming apparatus is designed so that it matches a cassette formed by coupling the main container to the sub container in such a manner that it can accommodate a standard A4 or letter size sheet. A cassette formed by coupling the containers so that it is capable of accommodating larger-size sheets is housed in the image-forming apparatus with part of the cassette protruding from the apparatus. In this way, a reduction in the size of the image-forming apparatus can be achieved, and it is therefore possible to provide a desktop image-forming apparatus which is in great demand.

Furthermore, since the manufacturer can store such a cassette in a disassembled state with the main container and the sub container separated from each other, a large storage space, which would otherwise be required, is unnecessary.

DETAILED DESCRIPTION OF THE PREFERRED EMBODIMENTS

A first embodiment of the present invention will be described below with reference to FIGS. 1 through 4.

Figure 1:
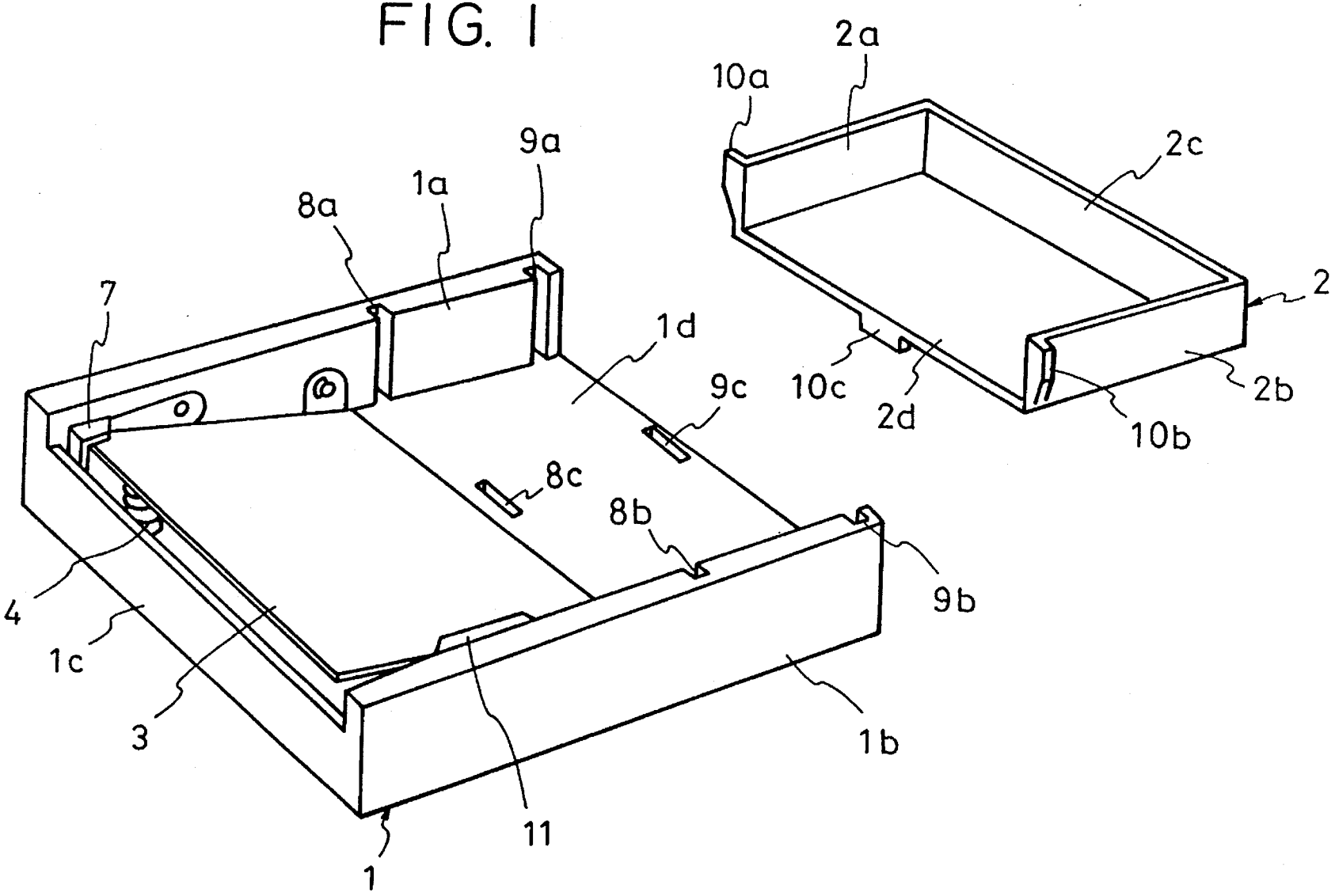
FIG. 1 is an exploded perspective view of a sheet-accommodating cassette showing a first embodiment of the present invention.

Referring first to FIG. 1, a sheet-accommodating cassette includes a main container 1 and a sub container 2. The main container 1 and the sub container 2 can be coupled to each other to form the sheet-accommodating cassette.

The main container 1 is made up of two side walls 1*a* and 1*b*, a bottom portion 1*d* and a front wall 1*c* provided on the front side of the cassette relative to the direction of feeding of sheets. An intermediate plate 3 for landing and retaining sheets placed thereon, a spring 4 for urging the intermediate plate 3 toward a sheet feed means, and a separation claw 7 for separating sheets one at a time are provided on main container 1.

In main container 1, engagement grooves 8*a* and 8*b* and an engagement hole 8*c*, used to accommodate letter size sheets, are formed in the two side walls 1*a* and 1*b* and the bottom portion 1*d*, respectively. Also, engagement grooves 9*a* and 9*b* and an engagement hole 9*c*, used to accommodate legal size sheets, are formed in the two side walls 1*a* and 1*b* and the bottom portion 1*d*, respectively.

The sub container 2 is made up of two side walls 2*a* and 2*b*, a bottom portion 2*d* and a rear wall 2*c* provided close to the rear end portion of the sheet. In sub container 2, protrusions or engagement ribs 10*a* and 10*b* are formed on the side walls 2*a* and 2*b*, respectively, and an engagement rib 10*c* is formed on the bottom portion 2*d*.

Figure 2:
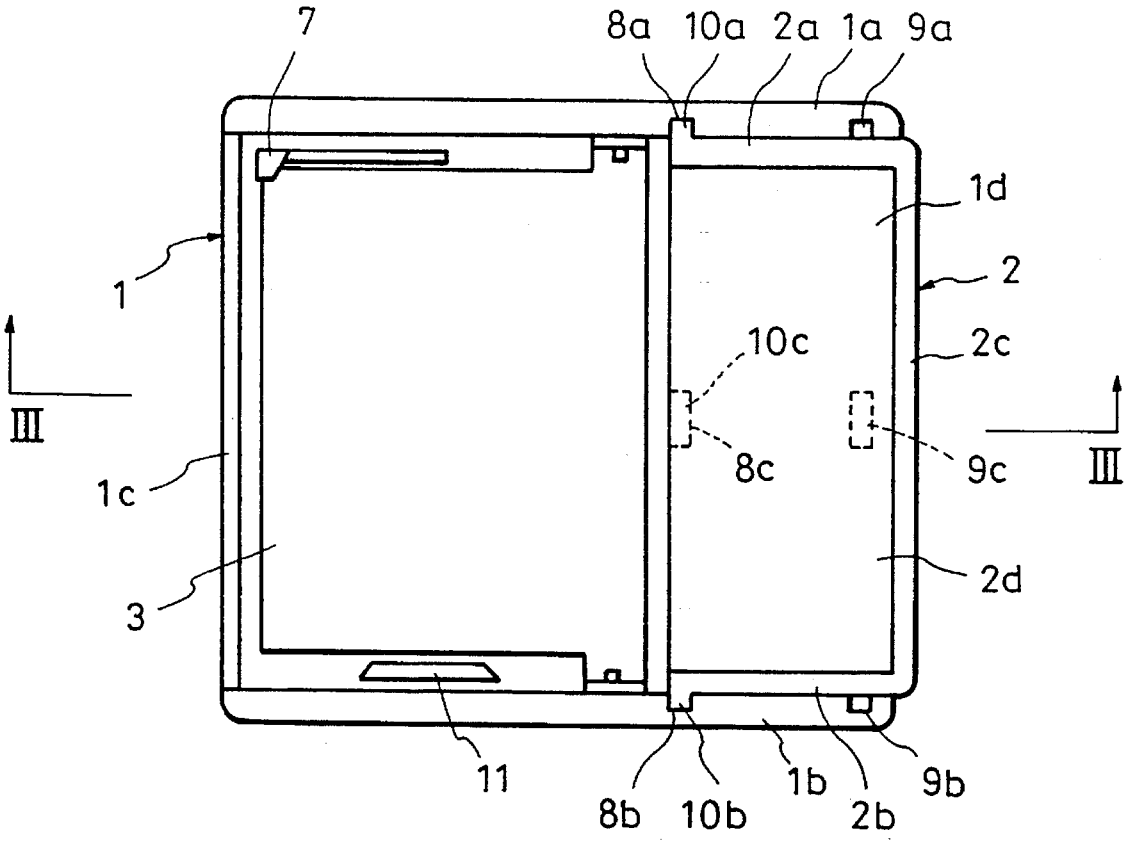
FIG. 2 is a plan view showing how a main container and a sub container are coupled to each other when letter size sheets are accommodated in the sheet-accommodating cassette shown in FIG. 1.
Figure 3:
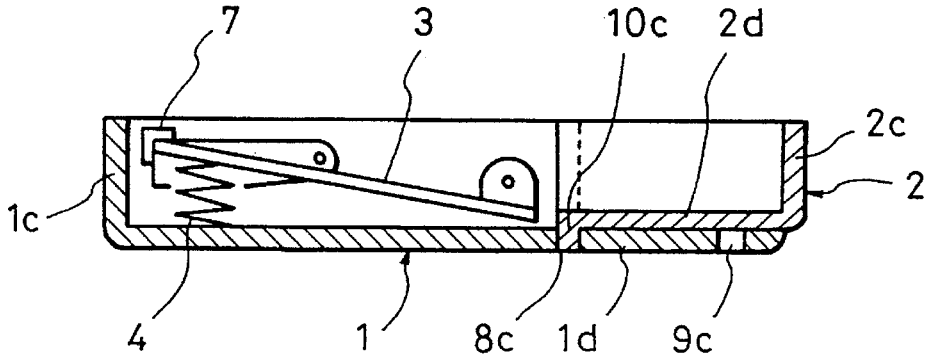
FIGS. 3 is a longitudinal cross-sectional view of the sheet-accommodating cassette shown in FIG. 2.
Figure 4:
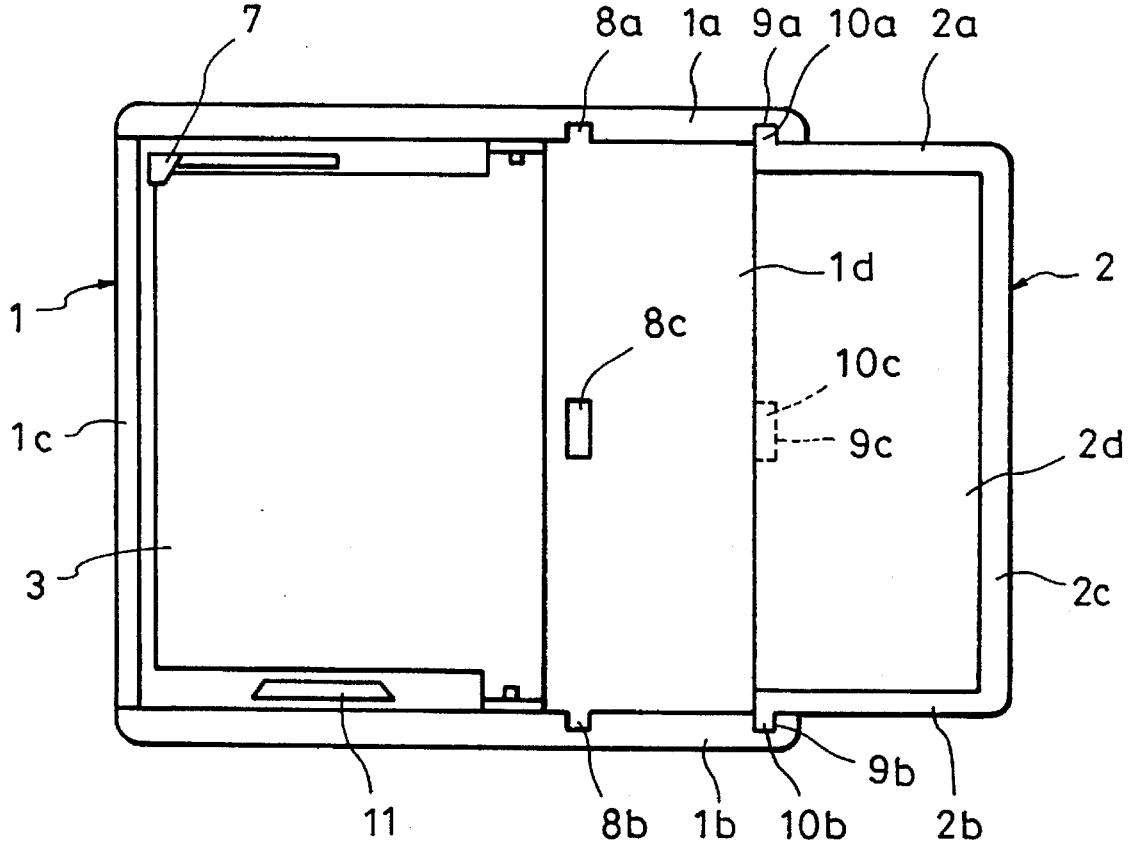
FIG. 4 is a plan view showing how a main container and a sub container are coupled to each other in the sheet-accommodating cassette shown in FIG. 1 to accommodate legal size sheets.

A sheet-accommodating cassette capable of accommodating letter size sheets is formed by bringing the engagement ribs 10*a*, 10*b* and 10*c* of sub container 2 into engagement with the engagement grooves 8*a* and 8*b* and the engagement hole 8*c* of main container 1, respectively, as shown in FIGS. 2 and 3. A sheet-accommodating cassette capable of accommodating legal size sheets is formed by bringing the engagement ribs 10*a*, 10*b* and 10*c* of the sub container 2 into engagement with the engagement grooves 9*a* and 9*b* and the engagement hole 9*c* of the main container 1, respectively, as shown in FIG. 4.

In the sheet-accommodating cassette formed by coupling the main and sub containers 1 and 2 to each other in the manner described above, main container 1 and sub container 2 are coupled to each other in three planes with the two side walls and the bottom portion of main container 1 engaged with those of sub container 2, respectively. Consequently, the formed sheet-accommodating cassette has sufficient strength.

A side-restricting member 11 for guiding a side portion (a portion lateral to the direction of feeding of sheets) of the sheet is provided on main container 1. Regarding sub container 2, the inner side of each of side walls 2*a* and 2*b* guides the side portion of the sheet, while the rear wall 2*c* of sub container 2 guides the rear end portion of the sheet. Thus, whatever the size of the sheets accommodated in the cassette, letter size or legal size, the side portions and the rear end portion of the sheets can be guided by the side walls 2*a* and 2*b* and the rear wall 2*c*, respectively.

In addition, since sub container 2 is coupled to the main container 1 at a position sufficiently distant from intermediate plate 3, spring 4 and separation claw 7 provided on main container 1, the position of sub container 2 can readily be changed relative to main container 1. Also, since sub container 2 is mounted on main container 1 for use whatever size sheet is accommodated, there is no possibility that sub container 2 will be lost.

Figure 5:
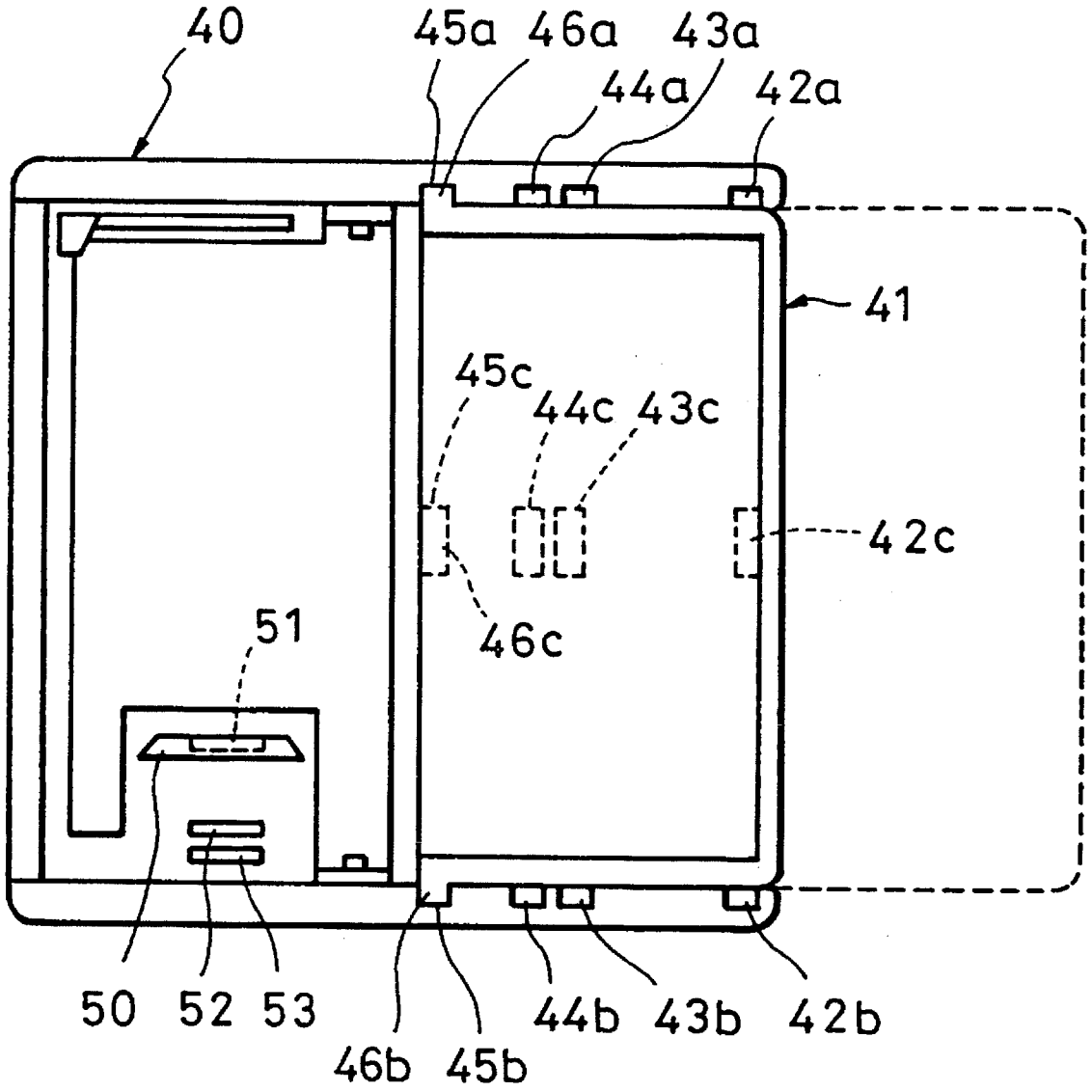
FIG. 5 is a plan view showing a second embodiment of the present invention.
Figure 6:
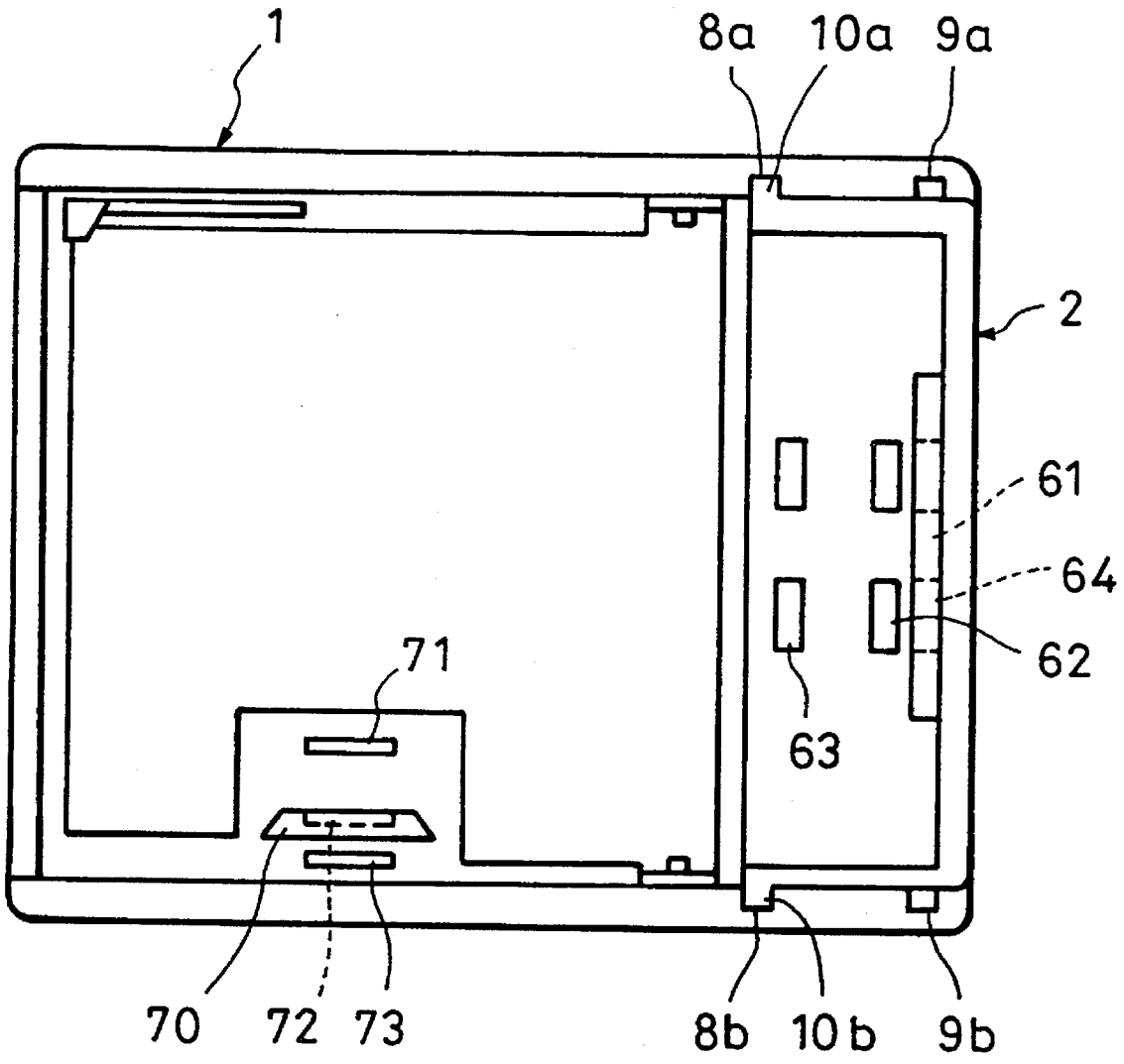
FIG. 6 is a plan view showing a third embodiment of the present invention.

A second embodiment of the present invention will be described below with reference to FIG. 5.

A main container 40 has four sets of engagement of positions, 42*a* through 42*c*, 43*a* through 43*c*, 44*a* through 44*c* and 45*a* through 45*c*, whereby main container 40 engages with sub container 41. Therefore, a sheet-accommodating cassette capable of accommodating sheets of any of four different sizes can be formed by bringing ribs 46*a* through 46*c* of the sub container 41 into engagement with any one set of engagement positions. More specifically, a sheet-accommodating cassette adapted to accommodate legal size sheets is formed by coupling the sub container 41 to the main container using engagement portions 42*a* through 42*c*. A sheet-accommodating cassette for A4 size sheets is formed by coupling sub container 41 to the main container using engagement portions 43*a* through 43*c*. A sheet-accommodating cassette for letter size sheets is formed by coupling the sub container 41 to the main container using engagement portions 44*a* through 44*c*. A sheet-accommodating cassette for B5 size sheets is formed by coupling the sub container 41 to the main container using engagement portions 45*a* through 45*c*. FIG. 5 illustrates the state of the sheet-accommodating cassette in which the main and sub containers are coupled to each other in such a manner that they can accommodate B5 size sheets.

Furthermore, a side-restricting member 50 for restricting the sheets in the direction lateral to the direction of feed thereof is movable within main container 40 in order to accommodate four sizes of sheets. To restrict letter size or legal size sheets, the side-restricting member 50 is brought into engagement with hole 53 formed in main container 40. To restrict A4 and B5 size sheets, the side-restricting member 50 is brought into engagement with holes 52 and 51, respectively. FIG. 5 illustrates the state of restriction of B5 size sheets. Sheets accommodated between side-restricting member 50 on one side, and the inner wall of main container 40 opposite side-restricting member 50 on the other sides, are thus restricted along both sides lateral to the direction of feed.

A third embodiment of the present invention will be described below with reference to FIG.

This embodiment differs from the first embodiment in that a rear end-restricting member 61 for restricting the rear end (relative to the direction of feed) of the sheets is provided on sub container 2. The rear end-restricting member 61 is engageable with any of engagement holes 62, 63 and 64.

When ribs 10*a*, 10*b* and 10*c* (not shown) of sub container 2 are in engagement with engagement grooves 8*a* and 8*b* and engagement hole 8*c* (not shown) of the main container, respectively, as shown in FIG. 2, the rear ends of letter size sheets can be restricted by bringing the rear end-restricting member 61 into engagement with engagement holes 62; the rear ends of B5 size sheets can be restricted by bringing the rear end-restricting member 61 into engagement with engagement holes 63; and the rear ends of A4 size sheets can be restricted by bringing the rear end-restricting member 61 into engagement with engagement holes 64. In addition, a side-restricting member 70 is brought into engagement with engagement hole 73 formed in the main container 1 for accommodating letter size sheets. The side-restricting member 70 is brought into engagement with engagement hole 72 for accommodating A4 sheets. The side-restricting member 70 is brought into engagement with engagement hole 71 for accommodating B5 sheets, as in the case of the second embodiment.

When legal size sheets are to be accommodated, the position of sub container 2 relative to the main container 1 is changed, as shown in FIG. 4. More specifically, the ribs 10*a*, 10*b* and 10*c* (not shown) of sub container 2 are brought into engagement with engagement grooves 9*a* and 9*b* and engagement hole 9*c* (not shown) of the main container 1, respectively.

A fourth embodiment of the present invention will be described below with reference to FIG. 7.

Main container 81 has groove-like slide guiding portions 81*a* and 81*b*, and sub container 82 has plate-like slider portions 82*a* and 82*b* which can slidably engage the slide guiding portions 81*a* and 81*b*, respectively. The two side walls of sub container 82 have a plate-like form and are elastically displaceable. Engagement protrusions 82*e* and 82*f* are formed at the distal end of the two side walls. Grooves 83*a*, 83*b* and 84*a* and 84*b*, which can respectively engage the engagement protrusions 82*e* and 82*f*, are formed in the two side walls of the main container 81. The engagement protrusions act as stoppers in conjunction with these grooves.

Figure 7:
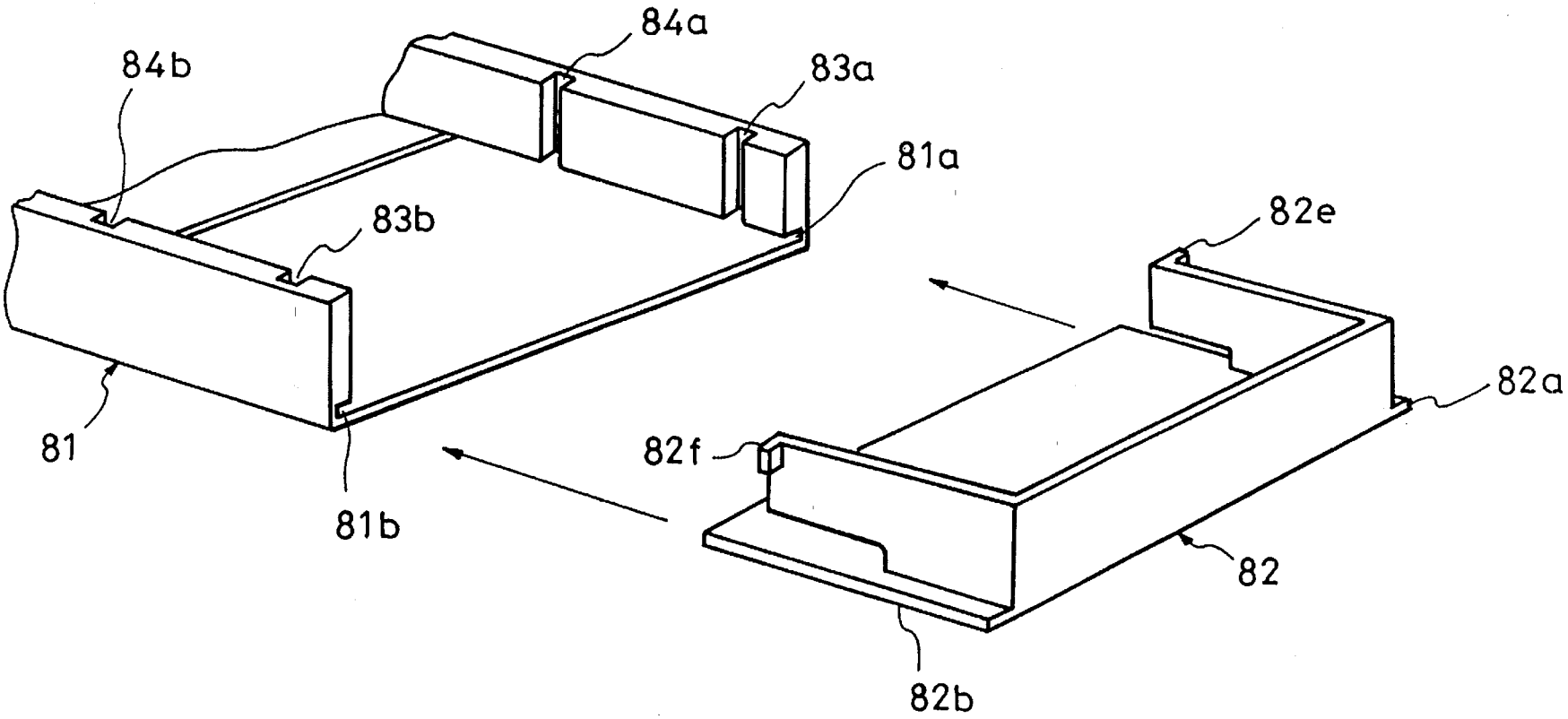
FIG. 7 is an exploded perspective view showing a fourth embodiment of the present invention.

When a cassette capable of accommodating legal size sheets is to be formed, the slider portions 82*a* and 82*b* of sub container 82 are brought into engagement with slide guiding portions 81*a* and 81*b* of main container 81, respectively, by moving sub container 82 from the position shown in FIG. 7 in the direction indicated by the arrows, whereby slider portions 82*a* and 82*b* are moved along slide guiding portions 81*a* and 81*b*. At that time, engagement protrusions 82*e* and 82*f* make contact with the inner surfaces of the side walls of main container 81 and are thereby elastically displaced inwardly. As sub container 82 is moved further, engagement protrusions 82*e* and 82*f* come into engagement with grooves 83*a* and 83*b* of main container 81, respectively, whereby the sub container 82 is positioned. Engagement protrusions 82*e* and 82*f* and grooves 83*a*, 83*b*, 84*a* and 84*b* act as stoppers by positioning the slider portions 82*a* and 82*b* in a location along the length of the slide guiding portions 81*a* and 81*b* in which the slider portions slide. Thus, positioning in the vertical and lateral directions is performed by the engagement of slide guiding portions 81*a* and 81*b* with slider portions 82*a* and 82*b* and positioning in the longitudinal direction is performed by the engagement of engagement protrusions 82*e* and 82*f* with grooves 83*a* and 83*b*, whereby main container 81 and sub container 82 are firmly coupled to each other.

A cassette capable of accommodating letter size sheets is similarly formed by pushing sub container 82 into main container 81 and thereby bringing engagement protrusions 82*e* and 82*f* into engagement with grooves 84*a* and 84*b*, respectively.

Application of the sheet-accommodating cassette (a universal cassette) of the first embodiment to an image-forming apparatus (a laser beam printer) will be described below with reference to FIG. 8.

Figure 8:
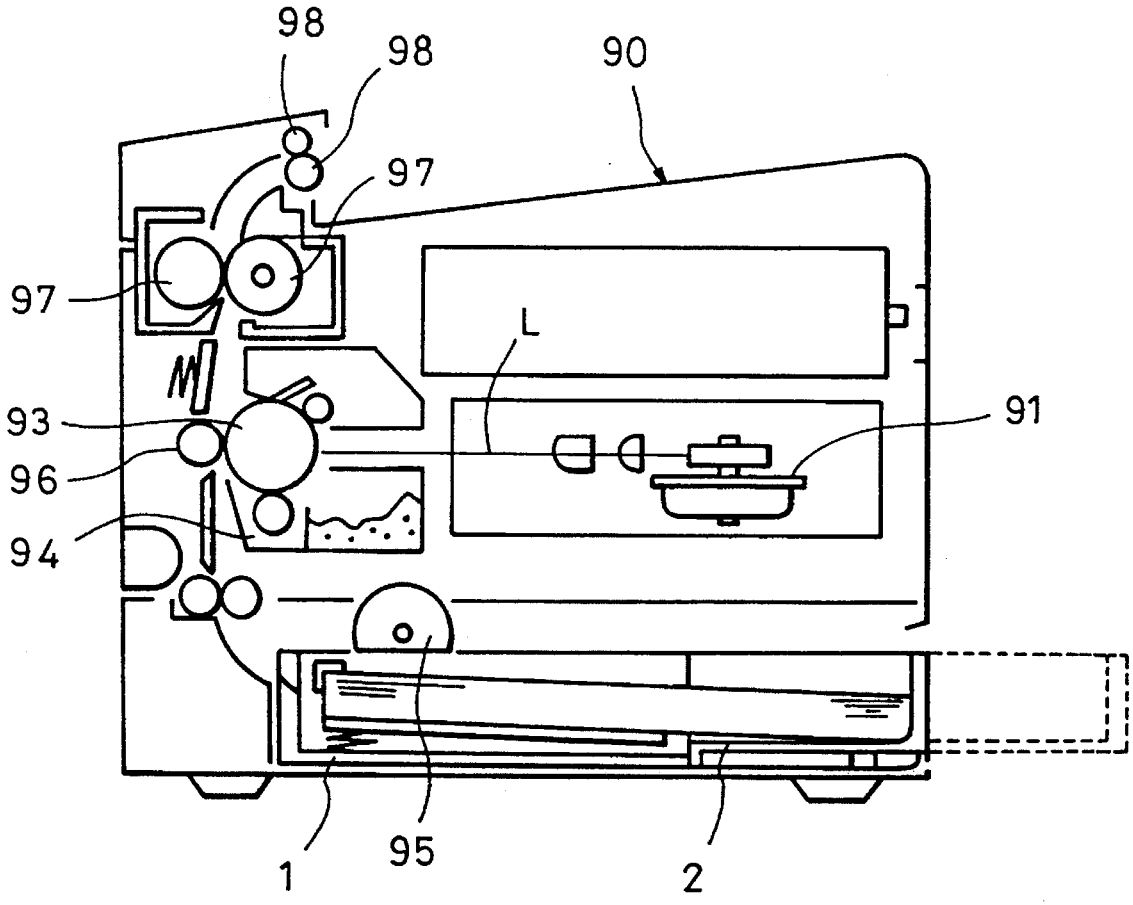
FIG. 8 is a longitudinal cross-sectional view of a printer on which the sheet-accommodating cassette shown in FIG. 1 is mounted.

A sheet-accommodating cassette capable of accommodating letter size sheets is housed in the image-forming apparatus in the manner shown by solid lines in FIG. 8. A sheet-accommodating cassette capable of accommodating legal size sheets is housed in the image-forming apparatus with the rear end of the cassette protruding from the image-forming apparatus body, as shown by the broken lines in FIG. 8.

The structure of a laser beam printer 90, serving as the image-forming apparatus, will be outlined below. A laser beam L is output from a laser scanner 91 in response to an image signal from a controller, which is not shown, to illuminate a photosensitive drum 93 and thereby form an electrostatic latent image on the photosensitive drum 93.

This electrostatic latent image is developed by a developer 94 to form a toner image. The formed toner image is transferred, by a transfer charger 96, to a sheet which has been sent out from the sheet-accommodating cassette by a feed roller 95.

Beyond the photosensitive drum 93 are disposed a pair of fixing rollers 97 and a pair of discharge rollers 98 to fix the toner image transferred onto the sheet and to discharge the fixed sheet to the outside of the apparatus, respectively.

Application of a sheet-accommodating cassette (a universal cassette) according to the present invention to a front-loading type image-forming apparatus will be described below with reference to FIGS. 9 through 12.

Figure 9:
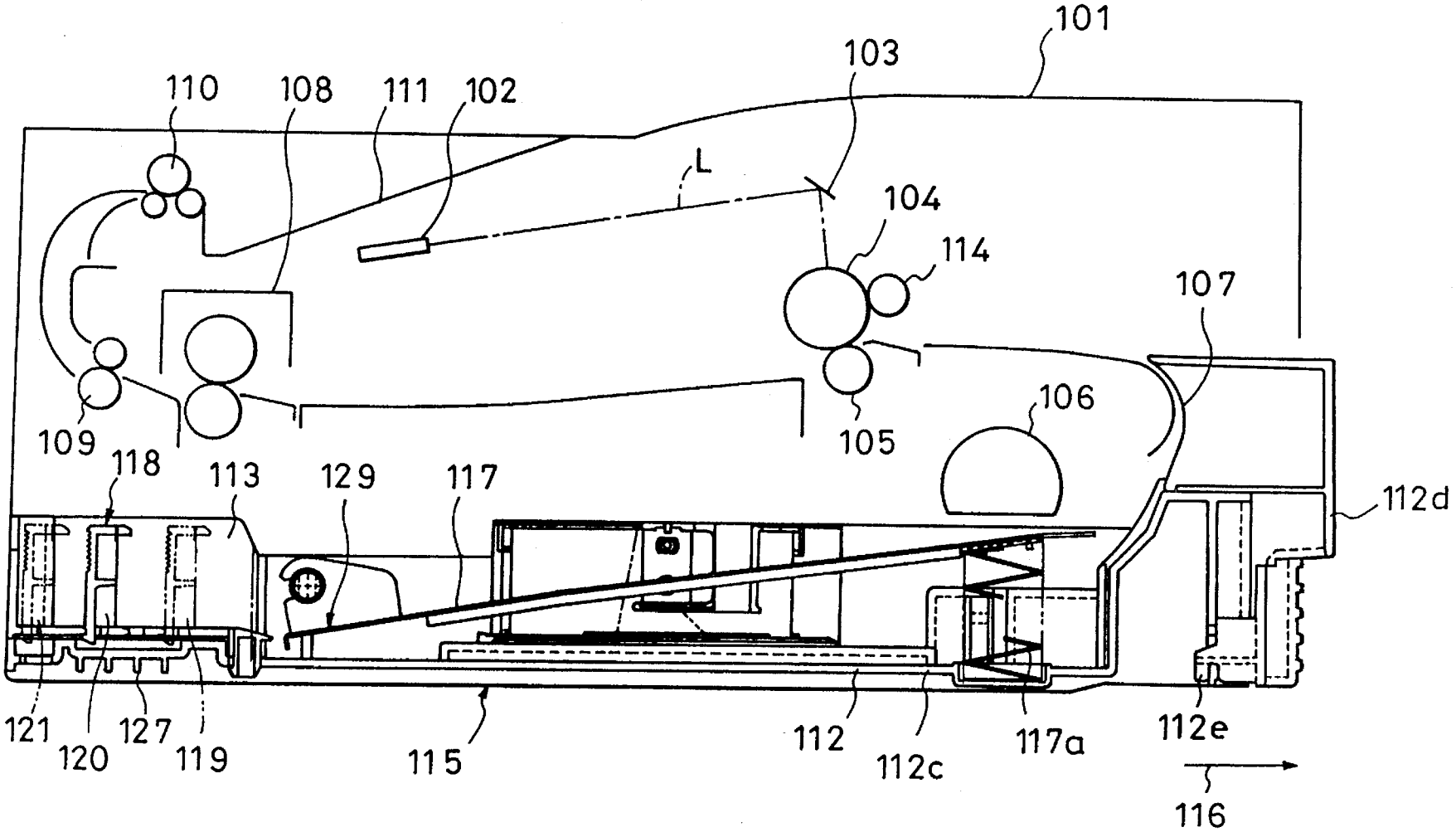
FIG. 9 is a longitudinal cross-sectional view of a printer on which a fifth embodiment of the sheet-accommodating cassette according to the present invention is mounted.

A sheet-accommodating cassette 115 is basically made up of a main container 112 and a sub container 113. FIG. 9 illustrates sheet-accommodating cassette 115 mounted on a printer body 101. The front of the printer body 101 is on the right as viewed in FIG. 9. The sheet-accommodating cassette 115 is mounted on printer 101 in such a manner that it can be pulled out in the direction indicated by arrow 116. The cassette can thus be pulled out in the same direction in which the sheet-feeding means feeds out sheets loaded in the cassette. Alternatively, the image-forming apparatus may be configured such that the cassette can be pulled out in the direction opposite to the direction of feeding-out of the sheets.

An intermediate plate 117 for loading sheets thereon is urged upward by a spring 117*a*. When rotated, a sheet feeding roller 106 having a notch makes contact with and thereby feeds out the sheet located on top of the pile of sheets. A sheet guide 107 is formed integrally with sheet-accommodating cassette 115. The sheet guide 107 turns over the sheet which has been fed out by the feed roller 106 and guides it to an image-forming section.

In the image-forming section, a laser beam L from a rotating polygonal mirror 102 is irradiated on the surface of a photosensitive drum 104 through a reflecting mirror 103 to form an electrostatic latent image on the photosensitive drum 104. A developing sleeve 114 makes the electrostatic latent image on photosensitive drum 104 visible using a developing toner, and a transfer portion 105, to which a high bias voltage is applied, transfers the visible image on the photosensitive drum 104 onto a sheet which has been fed out from sheet-accommodating cassette 115. A fixer 108 fixes the developed toner image which has been transferred onto the sheet by a heating roller. The sheet on which the image has been fixed is discharged onto a discharge tray 111 by discharge rollers 109 and 110.

Figure 10:
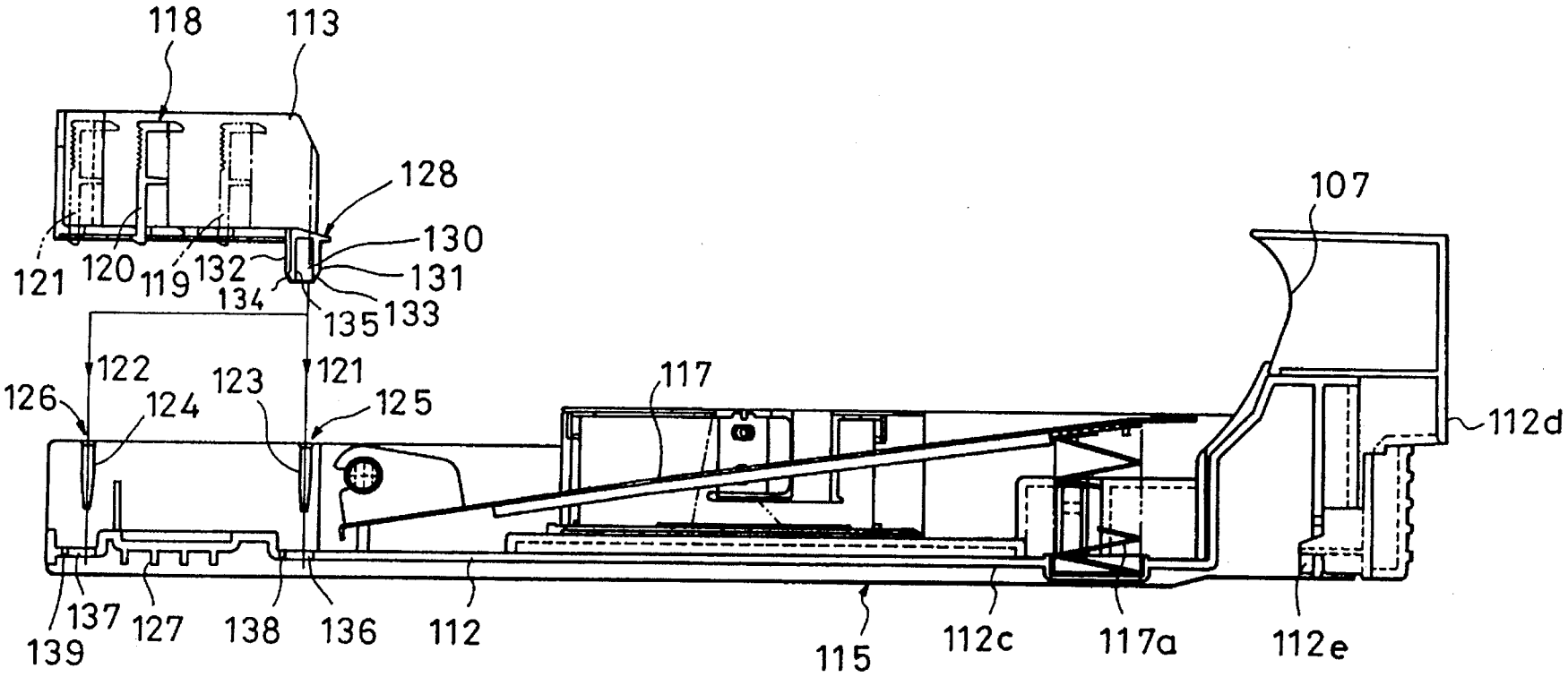
FIG. 10 is a longitudinal cross-sectional view illustrating the disassembled state of a main container and a sub container of the sheet-accommodating cassette of FIG. 9.

FIG. 10 illustrates the details of sheet-accommodating cassette 115.

Main container 112 has guide grooves 123 and 124 through which main container 112 engages sub container 113. A sheet-accommodating cassette 115 capable of accommodating B5, A4 and letter size sheets is formed by coupling the main container 112 to the sub container 113 in such a manner that a rib (not shown) of sub container 13 engages with guide groove 123 as shown by an arrow 121. A sheet-accommodating cassette 115 capable of accommodating legal size sheets is formed by bringing the rib (not shown) of sub container 113 into engagement with guide groove 124 as shown by arrow 122, as shown in FIG. 11.

The sub container 113 has a rear end-restricting member 118 which is mounted on sub container 113 at any of three positions consisting of position 119 at which the member restricts B5 size sheets, position 120 at which the member restricts letter size sheets and position 121 at which the member restricts A4 size sheets. FIG. 9 illustrates the configuration in which sub container 113 is in engagement with guide groove 123 (corresponding to B5, A4 and letter size sheets) of main container 112 while rear end-restricting member 118 is in engagement with sub container 113 at the letter size position (the position indicated by solid lines) 120.

Figure 11:
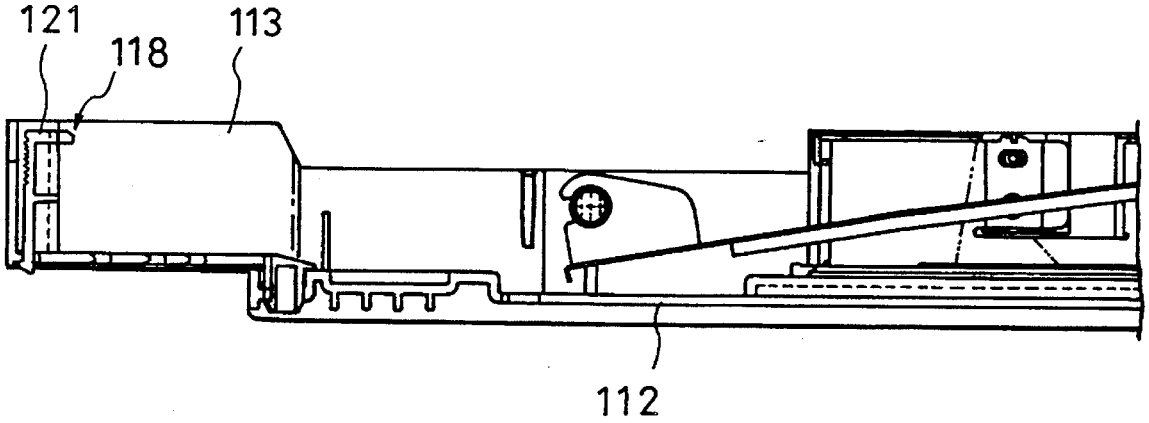
FIG. 11 is a plan view illustrating how the main container is coupled to the sub container in the sheet-accommodating cassette shown in FIG. 9 to accommodate legal size sheets.

FIG. 11 illustrates the configuration in which sub container 113 is in engagement with guide groove 124 of main container 112 in order to accommodate legal size sheets. In this configuration, rear end-restricting member 118 is in engagement with sub container 113 at position 121 for restricting A4 size sheets. When sub container 113 is mounted on main container 112 in such a manner that it corresponds to legal size sheets, rear end-restricting member 118 is engaged with sub container 113 at position 121, at which it restricts A4 size sheets, whereby a cassette capable of accommodating legal size sheets is provided. In other words, the position on sub container 113 at which the rear end-restricting member 118 is mounted for accommodation of sheets of A4 and the position at which the rear end-restricting member 118 is mounted for accommodation of legal size sheets are the same. The position on main container 112 at which sub container 113 is mounted determines the size of the sheets to be accommodated in the cassette.

As shown in FIG. 10, guide grooves 123 and 124 of main container 112 have a lever-like form and chamfered portions 125 and 126, respectively, so as to allow sub container 113 to be readily mounted on and removed from main container 112.

A plurality of ribs 127 are provided on the bottom portion of the rear portion of main container 112, through which sub container 113 is brought into engagement, to reinforce that portion of main container 112. Although a conventional, normally-employed sheet-accommodating cassette has a box-like shape, the main container of the sheet-accommodating cassette 115 according to the present embodiment has an open rear end portion (the left portion as viewed in FIG. 9), and thus has somewhat decreased strength. Hence, ribs 127 are provided to reinforce main container 112. The provision of the reinforcing ribs 127 makes the strength of the entire sheet-accommodating cassette equivalent to that of a conventional sheet-accommodating cassette and assures reliable engagement of sub container 113.

As shown in FIG. 10, sub container 113 has at its bottom portion a tapered portion 128 in order to improve the setting operation of a pile of sheets. A pile of sheets is set from the front side of the apparatus, i.e., from the right side as viewed in FIG. 9. The tapered portion 128 makes sub container 113 lower than the left end 129 of intermediate plate 117, preventing the sheets from being caught or turned upward during the setting operation. Even when sub container 113 is located at the legal size position, tapered portion 128 of sub container 113 reduces the shoulder between container 112 and sub container 113 to a minimum, thus improving the ease and efficiency of the paper setting function.

As shown in FIG. 10, sub container 113 has a positioning engaging portion 130 in order to position the sub container and to prevent detachment of the sub container by a latching mechanism. When the sub container is coupled to the main container such that the cassette can accommodate B5, A4 or letter size sheets, the positioning engaging portion 130 is brought into engagement with hole 136 of main container 112. When the sub container is coupled to the main container for accommodation of legal size sheets, the positioning engaging portion 130 is brought into engagement with hole 137 of main container 112.

The positioning engaging portion 130 has side surfaces 131 and 132 which can engage the corresponding hole 136 or 137 of main container 112. Side surfaces 131 and 132 have chamfered portions 133 and 134, respectively, in order to ease the insertion of positioning engaging portion 130 into hole 136 or 137.

Also, positioning engaging portion 130 has a detachment-preventing latching portion 135 which can engage rising portion 138 of hole 136 of main container 112 or rising portion 139 of hole 137. The detachment-preventing latching portion 135 is elastically deformable so that it can raise the rising portion 138 or 139 and thereby latch sub container 113 onto main container 112 securely enough to prevent detachment of the sub container.

Since detachment-preventing latching portion 135 is formed on side surface 132 of positioning engaging portion 130, it can be accurately positioned with respect to rising portion 138 or 139 of main container 112. Therefore, the amount of elastic deformation of the detachment-preventing latching portion 135 is uniform, and a latching operation having less variation can thus be obtained.

Furthermore, since the detachment-preventing latching portion 135 is in side surface 132 of positioning engaging portion 130, even when sub container 113 is handled roughly and is subjected to impact, it is less likely that the detachment-preventing latching portion 135 may break or be damaged. Therefore, impairment of the function of the detachment-preventing latching portion 135 by the operation of the user can be eliminated.

Figure 12:
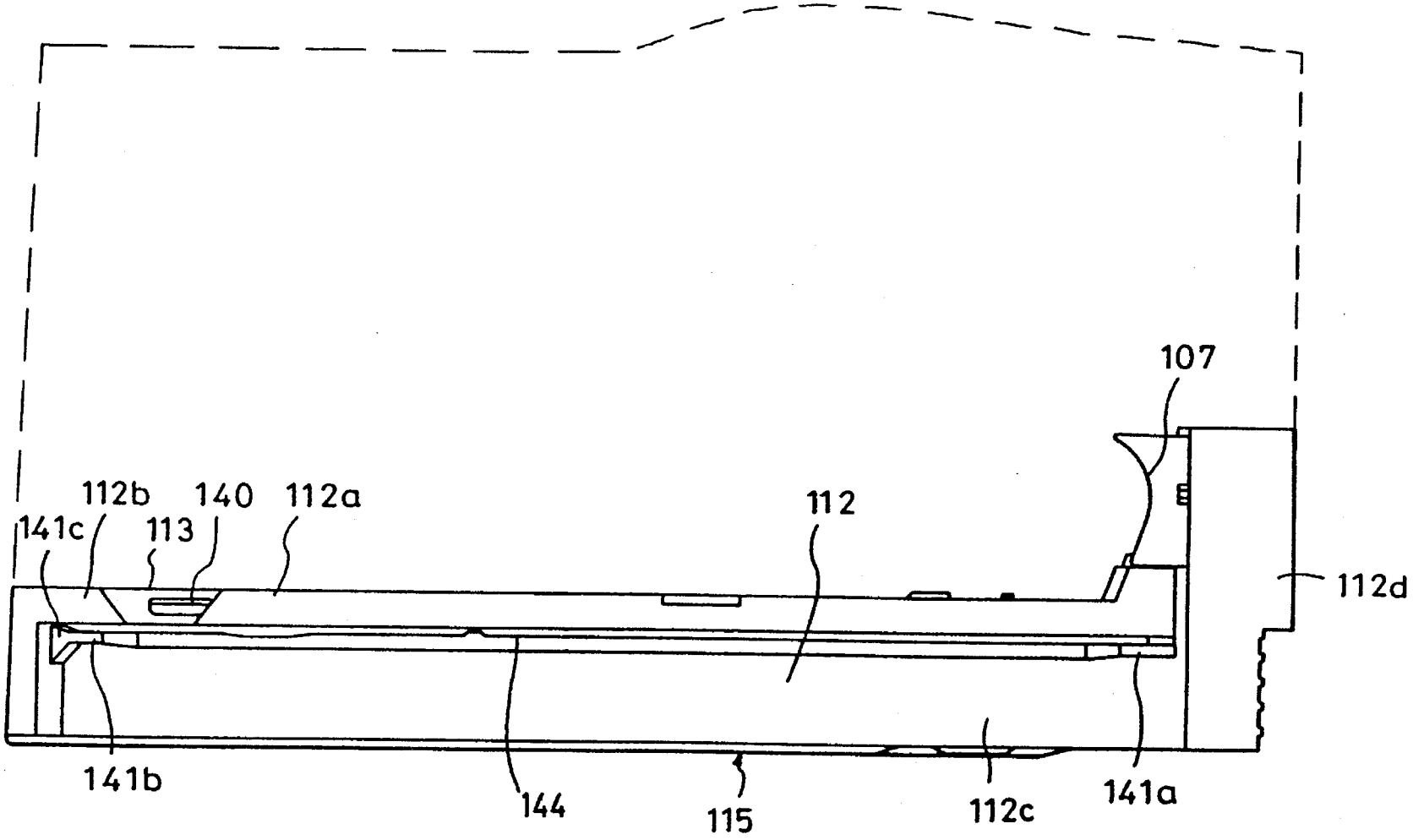
FIG. 12 is a side elevational view of the sheet-accommodating cassette shown in FIG. 9.

FIG. 12 is a side elevational view of sheet-accommodating cassette 115. Main container 112 has a guide groove 141, consisting of 141*a* and 141*b*, formed on the two side surfaces thereof substantially along the entire length of the sheet-accommodating cassette. The guide grooves 141*a* and 141*b* are positioned at and guided by a guiding member 144 of the printer body 101. The guide groove 141 has an enlarged groove portion 141*c* at the end thereof from which the guiding member of the printer body 101 is inserted (the left side as viewed in FIG. 11) in order to improve the ease with which the cassette is mounted on the printer body 101.

Since the guide groove 141 is provided along the entire length of main container 112 of sheet-accommodating cassette 115, the ease with which sheet-accommodating cassette 115 is mounted on the printer body 101 and the positioning accuracy of the sheet-accommodating cassette 115 are improved. Therefore, sheet-accommodating cassette 115 has the same basic performance as that of a conventional universal cassette.

An upper portion of each of side surfaces 112*a* and 112*b* of the main container 112 has a notched portion. A recessed portion 140 provided in sub container 113 opposes the notched portion so that the user can grip recessed portion 140 by hand and thereby operate sub container 113. Thus, ease of operation for the user is improved.

As described above with reference to FIGS. 9 through 12, since main container 112 and sub container 113 are coupled to each other with three surfaces of one engaged with three surfaces of the other by bringing a rib (not shown) of the sub container 113 into engagement with the guide groove 125 or 126 of the main container 112 and then by bringing the positioning engaging portion 130 of the sub container 113 into engagement with the hole 136 or 137 formed in the bottom portion of main container 112, main container 112 can be coupled securely to sub container 113. In addition, since the tapered portion is formed in each of the many engaging portions, sub container 113 can readily be mounted on and removed from main container 112. Thus, the size of the sheet-accommodating cassette can be reduced without undermining the basic performance of the conventional universal cassette.

The structure of the sheet-accommodating cassette 115 which enables its production cost to be lower than that of a conventional cassette will be described below.

In order to satisfy the various demands of different users, image-forming apparatuses having the same function but having a plurality of different appearances are available. The design of the exterior of the sheet-accommodating cassette must be altered to match the design of the image-forming apparatus body. Hence, sheet-accommodating cassettes having a plurality of different designs are prepared. This, however, means that a plurality of large molds must be prepared for molding the different types of sheet-accommodating cassettes, and production costs are thus increased.

Hence, in this embodiment, the main container 112 of sheet-accommodating cassette 115 is divided into a body portion 112*c* and a cassette exterior portion 112*d* having an exterior surface which forms part of the exterior of the image-forming apparatus, as shown in FIG. 9. The body portion 112*c* and the cassette exterior portion 112*d* are coupled to each other by means of a hook 112*e* or any other commonly employed coupling means, such as screws. The cassette exterior portion 112*d* has a handle portion so that the user can pull the handle portion to draw out the sheet-accommodating cassette 115. It is also possible that a plurality of hooks 112*e* may be provided in such a manner that they are separated from each other in the vertical direction, as shown in FIG. 13.

Body portion 112*c* has a sheet-guiding portion 107 which turns over the sheet which has been fed out from the cassette by the feed roller 106 relative to the orientation in which the sheet is fed to the image-forming section.

In the case of a sheet-accommodating cassette which is formed by coupling the body portion 112*c* with the cassette exterior portion 112*d*, the cassette exterior surface alone is changed so that it matches the design of printer body 101. Therefore, a plurality of small molds only are necessary for molding the cassette exterior surface, and the production cost of the cassette can thus be greatly reduced.

Figure 13:
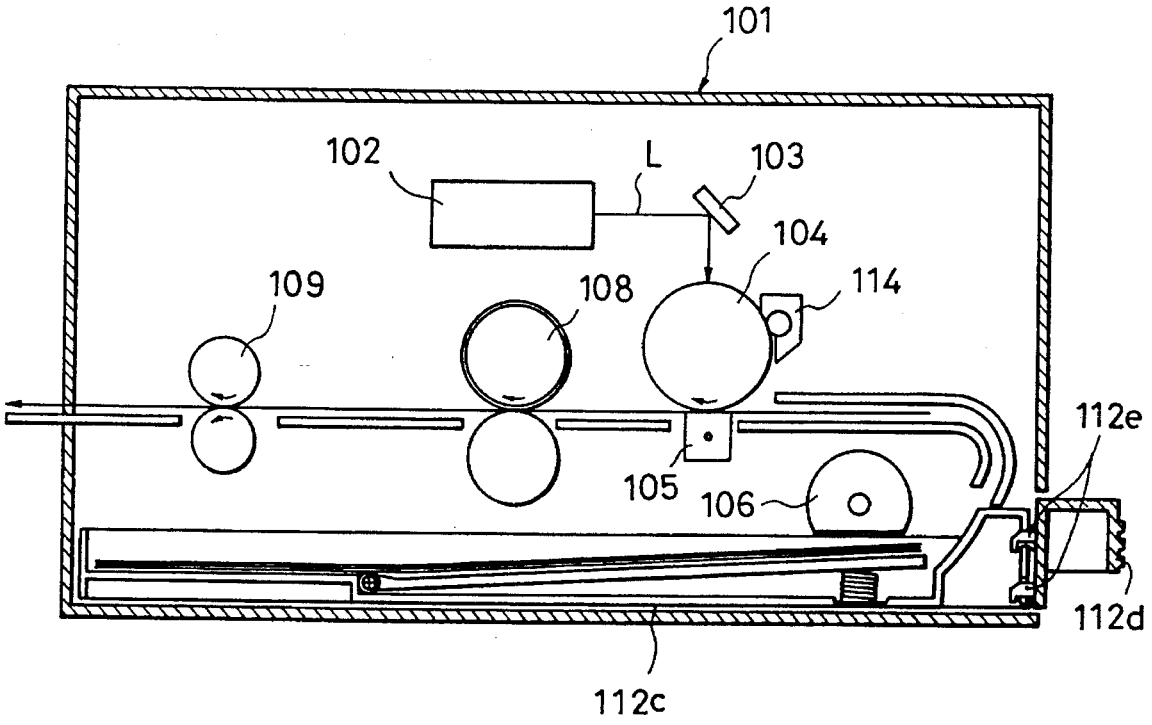
FIG. 13 is a longitudinal cross-sectional view showing how a cassette, in which a cassette exterior surface is formed separately, is mounted on the image-forming apparatus.

FIG. 13 shows a conventional sheet-accommodating cassette body with a cassette exterior portion coupled thereto. The sheet-accommodating cassette body is a single unit which is not divided into a main container and a sub container.

The present invention is not limited to the embodiments described herein. For example, although the embodiments describe a cassette in which the ribs of the sub container are brought into engagement with grooves and holes formed in the main container, the objects of the present invention may be achieved by a cassette in which ribs formed on the main container are brought into engagement with grooves and holes formed in the sub container. Furthermore, although the main container and the sub container are coupled to each other by engagement of the ribs with the grooves or holes in the above-described embodiments, they may also be coupled by any other coupling means having adequate strength, such as screws. Furthermore, although the sub container has a box-like form, the form thereof is not so limited, but a plate-like form in which a rear end is formed by bending the plate-like form may also be employed.

The present embodiments describe a sheet-accommodating cassette which accommodates cut sheets. However, the objects of this invention may be achieved by a sheet-accommodating cassette which accommodates a paper roll.

The present embodiments describe a paper-feeding cassette. However, the objects of this invention may be achieved by a paper-discharging cassette which accommodates sheets discharged from the image-forming apparatus or the like.

Although the sheet-accommodating cassette according to the present invention has been applied to a laser beam printer as the image-forming apparatus, it may also be applied to another image-forming apparatus, such as a copying machine, a facsimile machine, or an ink jet printer.

What is claimed is:

1. A sheet-accommodating cassette comprising:

a cassette body for accommodating sheets, said cassette body comprising a main container and a sub container, each of said main container and said sub container having a box shape that is open at one side surface thereof and two side surfaces and a bottom surface of each container having engagement means for coupling said main container and said sub container to each other with the open side surface facing each other in a position corresponding to the accommodated sheets' size wherein said engagement means comprises engagement ribs provided on one of said containers and engagement grooves provided on the other container, said engagement grooves engaging said engagement ribs.

2. A sheet-accommodating cassette according to claim 1, wherein said main container has an intermediate plate for loading sheets thereon, and urging means for urging said intermediate plate in one direction.

3. A sheet-accommodating cassette according to claim 1, wherein said main container has a movable restricting member for restricting a portion of the accommodated sheets.

4. A sheet-accommodating cassette according to claims 3, wherein said restricting member is a side-restricting member for restricting a side portion of the sheets.

5. A sheet-accommodating cassette according to claim 3, wherein said restricting member is a rear end restricting member for restricting rear ends of the sheets.

6. A sheet-accommodating cassette comprising:

a cassette body for accommodating sheets, said cassette body comprising a main container and a sub container, each having a box shape that is open at one side surface thereof, said main container and said sub container being slidably engaged to each other, and each of said main container and said sub container having engagement means for coupling said main container and said sub container to each other with the open side surface facing each other in a position corresponding to the accommodated sheets' size, wherein said engagement means comprises engagement members disposed on side surfaces of each container and said engagement members are elastically engageable to position said containers in a sliding juxtaposition and wherein said engagement members are grooves provided on side surfaces of one of said containers and protrusions provided on side surfaces of the other container in such a manner as to be elastically engageable with said grooves.

7. A sheet-accommodating cassette according to claim 6, wherein one of said main container and said sub container includes slide guiding portions and the other of said containers includes slider portions slidably engaged with said slide guiding portions.

8. An image forming apparatus in which an image is formed on a sheet fed by sheet feeding means from a sheet-accommodating cassette housed in an image-forming apparatus body having an exterior surface to image-forming means by said sheet feeding means, said sheet-accommodating cassette comprising:

a cassette body comprising a main container and a sub container each having a box shape that is open at one side surface thereof and two side surfaces, and a bottom surface of each container having engagement means for coupling said main container and said sub container to each other with the open side surface facing each other at one of a plurality of positions selected according to the sheets' size wherein said engagement means comprises engagement ribs provided on one of said containers and engagement grooves provided on the other container, said engagement grooves engaging said engagement ribs.

9. An image-forming apparatus according to claim 8, wherein the sheet-accommodating cassette, when formed by coupling said main container to said sub container such that said cassette is capable of accommodating sheets of a large size, is housed in said image-forming apparatus body with part of said cassette protruding from said image-forming apparatus body.

10. An image-forming apparatus according to claim 8, wherein said sheet-accommodating cassette is housed in said image-forming apparatus body such that it can be pulled out in a direction from said image-forming apparatus, said sheet-feeding means feeding out the sheets in a direction opposite to the direction in which said sheet-accommodating cassette is pulled out.

11. An image-forming apparatus according to claim 8, wherein said sheet-accommodating cassette is housed in said image-forming apparatus body in such a manner that it can be pulled out in a direction from said image-forming apparatus, said sheet-feeding means feeding out the sheets in the same direction as that in which said sheet-accommodating cassette is pulled out.

12. An image-forming apparatus according to claim 11, wherein said sheet-accommodating cassette has a sheet guiding portion which turns over the sheet which has been fed out by said sheet-feeding means so that it can be conveyed to said image-forming means.

13. An image-forming apparatus according to claim 8, wherein said main container includes a body portion and a cassette exterior portion having an exterior surface which constitutes part of the exterior surface of said image-forming apparatus body.

14. An image-forming apparatus according to claim 13, wherein said cassette exterior portion has a sheet guiding portion which turns over the sheet which has been fed out by said sheet-feeding means so that it can be conveyed to said image-forming means.

15. An image-forming apparatus in which an image is formed on a sheet sent from a sheet-accommodating cassette housed in an image-forming apparatus body, said sheet-accommodating cassette comprising:

a cassette body comprising a main container and a sub container each having a box shape that is open at one side surface thereof, said main container and said sub container being slidably engaged to each other, each of said main container and said sub container having an engagement portion for coupling said main container and said sub container to each other with the open side surface facing each other in a position corresponding to the accommodated sheets' size, wherein said engagement portion includes elastically engageable engagement members disposed on side surfaces of each container to position said containers in a sliding juxtaposition and wherein said engagement members are grooves provided on side surfaces of one of said containers and protrusions provided on side surfaces of the other container in such manner as to be elastically engageable with said grooves.

16. An image forming apparatus in which an image is formed on a sheet fed by sheet feeding means from a sheet-accommodating cassette housed in an image forming apparatus body, said sheet-accommodating cassette comprising:

a cassette body for accommodating sheets, said cassette body comprising a main container for loading sheets therein and a sub container, said main container having engagement portions on inner side surfaces and said sub container having engagement portions on outer side surfaces for coupling said main container and said sub container to each other in a position corresponding to the accommodated sheets' size, and outer side surfaces of said main container having a guiding means for guiding said cassette body in said image forming apparatus body.

17. An image forming apparatus according to claim 16, wherein said main container has an intermediate plate for loading sheets thereon, and urging means for urging said intermediate plate in one direction.

18. An image forming apparatus according to claim 16, wherein said guiding means comprises guide grooves slidably engaging with guiding members disposed on said image forming apparatus body.

* * * * *